US005766817A

United States Patent [19]

Cheng et al.

[11] Patent Number: 5,766,817

[45] Date of Patent: Jun. 16, 1998

[54] TONER MINIEMULSION PROCESS

[75] Inventors: Chieh-Min Cheng, Rochester; Min-Hong Fu, Webster, both of N.Y.

[73] Assignee: Xerox Corporation, Stamford, Conn.

[21] Appl. No.: 958,397

[22] Filed: Oct. 29, 1997

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 3,674,736 | 7/1972 | Lerman et al. . | |
| 4,137,188 | 1/1979 | Uetake et al. . | |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. . | 430/137 |
| 5,346,797 | 9/1994 | Kmiecik-Lawrynowicz et al. . | 430/137 |
| 5,348,832 | 9/1994 | Sacripante et al. | 430/109 |
| 5,364,729 | 11/1994 | Kmiecik-Lawrynowicz et al. . | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. . | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,561,025 | 10/1996 | Torres et al. | 430/137 |
| 5,567,566 | 10/1996 | Mahabadi et al. | 430/137 |
| 5,585,215 | 12/1996 | Ong et al. | 430/107 |
| 5,650,255 | 7/1997 | Ng et al. | 430/137 |
| 5,650,256 | 7/1997 | Veregin et al. | 430/137 |

*Primary Examiner*—Roland Martin
*Attorney, Agent, or Firm*—E. O. Palazzo

[57] ABSTRACT

A process for the preparation of toner involving (i) aggregating a colorant dispersion with a latex miniemulsion containing polymer, an ionic surfactant, a cosurfactant, and a nonionic surfactant;

(ii) coalescing or fusing the aggregates generated; and optionally (iii) cooling, isolating, washing, and drying the toner, and wherein the polymer in said miniemulsion is of a diameter of from about 50 to about 500 nanometers.

24 Claims, No Drawings

TONER MINIEMULSION PROCESS

PENDING APPLICATIONS

Illustrated in U.S. Ser. No. 08/959,798 pending entitled "Toner Processes", filed concurrently herewith, the disclosure of which is totally incorporated herein by reference, is a process for the preparation of toner comprising (i) aggregating a colorant dispersion containing a suitable surfactant with a latex emulsion containing an anionic surfactant, a nonionic surfactant, and a water miscible chain transfer agent, or a nonionic surfactant with chain transfer characteristics to form toner sized aggregates;

(ii) coalescing or fusing said aggregates; and optionally (iii) isolating, washing, and drying the resulting toner.

Illustrated in copending application U.S. Ser. No. 08960,754, pending entitled "Surfactants", and U.S. Ser. No. 08/960,176, pending entitled "Toner Processes", the disclosures of each application being totally incorporated herein by reference, are cleavable surfactants and the use thereof in emulsion/aggregation and coalescence toner processes.

BACKGROUND OF THE INVENTION

The present invention is generally directed to toner processes, and more specifically, to processes which utilize aggregation and coalescence, or fusion of the latex, colorant, such as pigment, dye, or mixtures thereof, and optional additive particles. In embodiments, the present invention is directed to processes which provide toner compositions with a volume average diameter of from about 1 micron to about 20 microns, and preferably from about 2 microns to about 12 microns, and a narrow particle size distribution of, for example, about 1.10 to about 1.45 as measured by the Coulter Counter method, without the need to resort to conventional pulverization and classification methods. The resulting toners can be selected for known electrophotographic imaging and printing processes, including digital color processes. In embodiments, the present invention is directed to a process comprised of blending an aqueous colorant, especially pigment dispersion containing an ionic surfactant with a miniemulsion latex emulsion comprised of polymer particles, preferably submicron in size, of from, for example, about 50 nanometers to about 500 nanometers and preferably from about 100 nanometers to about 300 nanometers in volume average diameter, a nonionic surfactant and an ionic surfactant of opposite charge polarity to that of the ionic surfactant in the pigment dispersion, thereafter heating the resulting flocculent mixture at, for example, below about the resin glass transition temperature, and more specifically, from about 35° C. to about 60° C. (Centigrade) to form toner sized aggregates of from about 2 microns to about 20 microns in volume average diameter, and which toner is comprised of polymer, colorant, especially pigment and optionally additive particles, followed by heating the aggregate suspension above about the resin, or polymer glass transition temperature, and more specifically, at, for example, from about 70° C. to about 100° C. to effect coalescence or fusion of the components of the aggregates and to form mechanically stable integral toner particles. The miniemulsion contains oil, or monomer, water, surfactants, and preferably a cosurfactant, such as an alcohol, an alkane, an ether, an alcohol ester, an amine, a halide, or a carboxylic acid ester, which cosurfactant is preferably inert, nonvolatile, water insoluble, liquid at a temperature of from about 40° C. to about 90° C., and contains a terminal aliphatic hydrocarbyl group with at least about 10 carbon atoms, and more specifically, from about 12 to about 24 carbon atoms, and mixtures thereof, and more specifically, an aliphatic alcohol with at least about 8 carbon atoms, such as from about 10 to about 25 carbon atoms, and an alkane with from about 10 to about 30 carbon atoms. The cosurfactant primarily functions to reduce the diffusion of monomer out of the monomer droplet and enables relatively stable miniemulsions because, it is believed, of the formation of intermolecular complexes at the oil/water interface. The complexes are believed to be liquid condensed and electrically charged thus creating a low, for example from about 0.5 dyne/centimeter to about 5 dyne/centimeter interfacial tension and high resistance to droplet coalescence.

The aforementioned toners are especially useful for imaging processes, especially xerographic processes, which usually require high toner transfer efficiency, such as those having a compact machine design without a cleaner, or those that are designed to provide high quality colored images with excellent image resolution and signal-to-noise ratio, and image uniformity.

PRIOR ART

There is illustrated in U.S. Pat. No. 4,996,127 a toner of associated particles of secondary particles comprising primary particles of a polymer having acidic, or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with a wide particle size distribution. Similarly, the aforementioned disadvantages, for example poor particle size distributions are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, wherein there is disclosed a process for the preparation of a copolymer of styrene and butadiene by specific suspension polymerization.

In U.S. Pat. No. 5,561,025 there are illustrated emulsion/aggregation/coalescence processes wherein water phase termination agents, that is chain transfer agents that are not water miscible.

Other prior art that may be of interest includes U.S. Pat. Nos. 3,674,736; 4,137,188 and 5,066,560.

Emulsion/aggregation processes for the preparation of toners are illustrated in a number of Xerox patents, the disclosures of each of which are totally incorporated herein by reference, such as U.S. Pat. No. 5,290,654, U.S. Pat. No.

5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; and 5,650,256

Processes for the preparation of spherical toners at coalescence temperatures of from about 100° C. to about 120° C. are illustrated in U.S. Pat. No. 5,501,935, the disclosure of which is totally incorporated herein by reference.

The appropriate components of the above patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant, especially pigment dispersions, thus enabling the achievement of excellent color print quality.

In a further feature of the present invention there is provided a process for the preparation of toner compositions with a volume average diameter of from between about 1 to about 20 microns, and preferably from about 2 to about 12 microns, and a particle size distribution of about 1.10 to about 1.35, and preferably from about 1.15 to about 1.25 as measured by a Coulter Counter without the need to resort to conventional classifications to narrow the toner particle size distribution.

In a further feature of the present invention there is provided a process for the preparation of toner by aggregation and coalescence, or fusion (aggregation/coalescence) of latex, pigment, and additive particles, and wherein the latex is a miniemulsion; and there is included therein a cosurfactant, or a hydrotrope, small water soluble molecules with minimum surface activity, such as sodium xylene sulfonate or sodium toluene sulfonate, can be selected to enhance latex polymer stability and reduce the amount of undesirable sediment.

In yet another feature of the present invention there are provided toner compositions with low fusing temperatures of from about 120° C. to about 180° C., and which toner compositions exhibit excellent blocking characteristics at and above about 45° C.

These and other features of the present invention are accomplished in embodiments by the provision of toners and processes thereof. In embodiments of the present invention, there are provided sediment free, or substantially sediment free processes for the preparation of toner compositions by the aggregation/coalescence of latex and colorant, especially pigment particles in the presence of a cosurfactant, and wherein the temperature of the aggregation may be selected to control the aggregate size, and thus the final toner particle size, and the coalescence temperature and time may be utilized to control the toner shape and surface properties.

Embodiments of the present invention include a process for the preparation of toner comprising (i) aggregating a colorant dispersion with a latex miniemulsion containing polymer, an ionic surfactant, a cosurfactant, and a nonionic surfactant;

(ii) coalescing or fusing the aggregates generated; and optionally (iii) cooling, isolating, washing, and drying the toner, and wherein the polymer in said miniemulsion is of a diameter of from about 50 to about 500 nanometers; a process wherein said aggregating is below about the polymer glass transition temperature present in the latex emulsion, the coalescing or fusing of said aggregates is above about the polymer glass transition temperature, and wherein said resin diameter is from about 100 to about 250 nanometers, and there results toner with a size of from about 2 to about 20 microns in volume average diameter; and wherein (iii) is accomplished; a process wherein said temperature below the glass transition temperature is from about 25° C. to about 60° C., and the heating above the glass transition temperature is from about 60° C. to about 100° C.; and wherein (iii) is accomplished; a process wherein said temperature below the glass transition temperature is from about 35° C. to about 55° C., and the heating above the glass transition temperature is from about 70° C. to about 95° C.; and wherein (iii) is accomplished; a process wherein the temperature at which said aggregation is accomplished controls the size of the aggregates, and wherein the final toner size is from about 2 to about 10 microns in volume average diameter, and wherein the temperature and time of said coalescence or fusion of the components of aggregates control the shape of the resultant toner; a process wherein the aggregation temperature is from about 45° C. to about 55° C., and wherein the coalescence or fusion temperature is from about 80° C. to about 95° C.; a process wherein the cosurfactant is selected from the group consisting of components of alkanes, hydrocarbyl alcohols, ethers, alkyl thiols, amines, halides, and esters; a process wherein the cosurfactant is an alkane with from about 10 to about 24 carbon atoms, and wherein said alkane is present in an amount of from about 0.05 to about 5 parts; a process wherein the cosurfactant is an alcohol, or an alkyl thiol; a process wherein the alcohol contains from about 10 to about 20 carbon atoms; a process wherein the alcohol is decanol, lauryl alcohol, tetradecanol, cetyl alcohol, or octadecanol; a process wherein the alcohol is present in an amount of from about 0.1 to about 5 parts; a process wherein the alkane is n-decane, dodecane, tetradecane, hexadecane, or octadecane; a process wherein the colorant is a pigment, and wherein said pigment dispersion contains an ionic surfactant, and the minilatex emulsion contains a nonionic surfactant and an ionic surfactant of opposite charge polarity to that of ionic surfactant present in said pigment dispersion; a process wherein the surfactant utilized in said colorant dispersion is a cationic surfactant, and the ionic surfactant present in the latex mixture is an anionic surfactant; a process wherein the aggregation is accomplished at a temperature of from about 15° C. to about 1° C. below the Tg of the latex polymer, or latex resin for a duration of from about 0.5 hour to about 3 hours; a process wherein the coalescence or fusion of the components of aggregates for the formation of integral toner particles comprised of colorant, resin and additives is accomplished at a temperature of about 85° C. to about 105° C. for a duration of from about 1 hour to about 5 hours; and (iii) is accomplished; a process wherein the latex polymer is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acryl acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), wherein said polymer is present in an amount of from about 80 percent by weight to about 98 percent by weight of toner, and wherein said colorant is a pigment; and (iii) is accomplished; a process wherein the latex polymer is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene, poly(butyl acrylate-butadiene), poly(styrene-isoprene); poly(methylstyrene-isoprene), poly(methyl methacrylate-isoprene), poly(ethyl methacrylate-isoprene), poly(propyl methacrylate-isoprene), poly(butyl methacrylate-isoprene), poly (methyl acrylate-isoprene), poly(ethyl acrylate-isoprene), poly(propyl acrylate-isoprene), and poly (butyl acrylate-isoprene); poly(styrene-propyl acrylate), poly(styrene-butyl acrylate), poly(styrene-butadiene -acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), wherein said polymer is optionally present in an amount of from 80 percent by weight to about 98 percent by weight of toner, and wherein said colorant is a pigment; a process wherein the anionic surfactant is selected from the group consisting of sodium dodecyl sulfate, sodium dodecylbenzene sulfate and sodium dodecylnaphthalene sulfate, and wherein colorant dispersion contains a cationic surfactant of a quaternary ammonium salt; a process wherein the colorant is carbon black, magnetite, cyan, yellow, magenta, and mixtures thereof; a process wherein (iii) is accomplished and the toner particles isolated are from about 2 to about 10 microns in volume average diameter, and the particle size distribution thereof is from about 1.15 to about 1.30, wherein each of the surfactants utilized represents from about 0.01 to about 5 weight percent of the total reaction mixture, and wherein there is added to the surface of the formed toner metal salts, metal salts of fatty acids, silicas, metal oxides, or mixtures thereof, each in an amount of from about 0.1 to about 10 weight percent of the obtained toner particles; a process wherein the polymer in said miniemulsion is of a diameter of from about 100 to about 400 nanometers, or wherein the polymer in said miniemulsion is of a diameter of from about 100 to about 300 nanometers; a process for the preparation of toner which comprises aggregating a colorant dispersion with a latex miniemulsion containing polymer of a diameter of from about 50 to about 500 nanometers, an ionic surfactant, an optional cosurfactant, and a nonionic surfactant;

coalescing the aggregates generated; and optionally isolating, washing, and drying the toner; a process wherein the cosurfactant is present; a process wherein the cosurfactant is an alkyl thiol which contains from about 10 to about 18 carbon atoms; and a process wherein the alkyl thiol is 1-decanethiol, or 1-dodecanethiol.

In embodiments thereof, the present invention relates to a direct toner preparative process comprised of blending an aqueous colorant dispersion containing, for example, a pigment, such as HELIOGEN BLUE™ or HOSTAPERM PINK™, and a cationic surfactant, such as benzalkonium chloride (SANIZOL B-50™), and a latex miniemulsion containing an anionic surfactant, such as sodium dodecylbenzene sulfonate (for example NEOGEN R™ or NEOGEN SC™), and cosurfactant, and wherein the latex polymer is derived from emulsion polymerization of monomers selected, for example, from the group consisting of styrene, acrylates, methacrylates, acrylonitrile, butadiene, acrylic acid, methacrylic acid, and the like, thereby resulting in the flocculation of the polymer particles with the pigment particles and optional additives; and which flocculent mixture, on further stirring at a temperature of from about 35° C. to about 60° C., results in the formation of toner sized aggregates having an aggregate size of from about 2 microns to about 20 microns in volume average diameter as measured by the Coulter Counter (Microsizer II), and a particle size distribution of about 1.15 to about 1.35; thereafter, heating the aggregate suspension at from about 70° C. to about 95° C. to form toner particles; followed by filtration, washing, and drying in an oven, or the like.

In embodiments, the present invention is directed to processes for the preparation of toner compositions which comprise blending an aqueous colorant dispersion preferably containing a pigment, such as carbon black, phthalocyanine, quinacridone or RHODAMINE B™ type red, green, brown, and the like with a cationic surfactant, such as benzalkonium chloride, with a minilatex emulsion derived from the emulsion polymerization of monomers selected from the group consisting of styrene, butadiene, acrylates, methacrylates, acrylonitrile, acrylic acid, methacrylic acid, and the like, and which latex contains an anionic surfactant, such as sodium dodecylbenzene sulfonate, a nonionic surfactant, and a cosurfactant, and which latex resin size is, for example, from about 50 to about 500 nanometers, and preferably from about 100 to about 250 nanometers as measured by light scattering technique on a Coulter N4 Plus Particle Sizer; heating the resulting flocculent mixture at a temperature below or about equal to the Tg of the polymer or resin formed in the latex, ranging, for example, from about 30° C. to about 55° C. for an effective length of time of, for example, 0.5 hour to about 2 hours to form toner sized aggregates; and subsequently heating the aggregate suspension at a temperature at or above the Tg of the latex polymer, for example from about 60° C. to about 100° C., to provide toner particles; and finally isolating the toner product by filtration, thereafter washing and drying in an oven, fluid bed dryer, freeze dryer, or spray dryer; whereby toner particles comprised of polymer, or resin, colorant, and optional additives are obtained.

Cosurfactants include, for example, alkanes, and hydrocarbyl alcohols, ethers, amines, halides and esters, which are inert, nonvolatile, water insoluble, liquids at a temperature of from about 40° C. to about 90° C., and contain a terminal aliphatic hydrocarbyl group, and mixtures thereof. The terminal aliphatic hydrocarbyl group of at least about 10, and more specifically, from about 10 to about 20 carbon atoms contained therein may be unsaturated, but is preferably saturated, and branched, but is preferably straight chain. These cosurfactants should be relatively highly water insoluble to the extent that in water they have a solubility of less than about $10^{-3}$ grams, preferably less than about $10^{-4}$ grams, and more preferably from about $10^{-6}$ grams to about $10^{-4}$ grams per liter of water. The molecular weight $M_w$, of the cosurfactant is, for example, not more than about 5,000, preferably not more than about 2,000, and still more preferably from about 100 to about 500. Examples of cosurfactants include alkanes, such as n-decane, n-tetradecane, n-hexadecane, n-octadecane, eicosane, tetracosane, 1-decene, 1-dodecene, 2-hexadecyne, 2-tetradecyne, 3-octyne, 4-octyne, and 1-tetradecene; alicyclic hydrocarbons, such as dodecyl cyclohexane; aromatic hydrocarbons, such as hexadecyl benzene; alcohols, such as decanol, lauryl alcohol, tetradecanol, cetyl alcohol, octadecanol, eicosanol, 1-heptadecanol and ceryl alcohol; hydrocarbyl alcohol esters of lower molecular weight carboxylic acids, such as cetyl acetate; ethers, such as octyl ether and cetyl ether; amines, such as tetradecyl amine, hexadecyl amine, and octadecyl amine; halides, such as hexadecyl chloride and other chlorinated paraffins; hydrocarbyl carboxylic acid esters of lower molecular weight alcohols, such as methyl, ethyl and isoamyl octanoate, methyl and octyl caprate, ethyl stearate, isopropyl myristate, methyl, isoamyl and butyl oleate, glyceryl tristearate, soybean oil, coconut oil, tallow, laurin, myristin, olein and the like. With the processes of the present invention, cosurfactants as illustrated herein are selected, preferably cosurfactants of dodecane, hexadecane, lauryl alcohol, or cetyl alcohol, and which cosurfactant is selected in various suitable amounts, such as from about 0.005 to about 5, and preferably from about 0.5 to about 3 weight percent, or parts based on the monomer, or monomers used to prepare the polymer resin. The cosurfactants increase the stability of the fine-size particle emulsions by inhibiting sedimentation or degradation caused by the tendency of the small particles or droplets to coalescence or diffuse molecularly. The cosurfactants should preferably be inert, and resistant to diffusion into aqueous medium.

Embodiments of the present invention include a process for the preparation of toner comprised of polymer and colorant, especially pigment, comprising (i) blending an aqueous pigment dispersion containing an ionic surfactant with a miniemulsion latex containing resin, or polymer, a nonionic surfactant and an ionic surfactant with a charge polarity opposite to that of ionic surfactant in the pigment dispersion, and a cosurfactant;

(ii) heating the resulting mixture at a temperature about 25° C. to about 1° C. below the Tg (glass transition temperature) of the latex resin, or polymer to form toner sized aggregates;

(iii) subsequently heating the aggregate suspension to a temperature of about 75° C. to about 120° C. to effect coalescence or fusion of the components of aggregates to enable formation of integral toner particles comprised of polymer, colorant, especially pigment, and optional additives; and cooling, followed by (iv) isolating the toner product by, for example, filtration, followed by washing and drying.

In embodiments, the present invention is directed to processes for the preparation of toner compositions which comprise (i) preparing an ionic colorant mixture by dispersing a colorant, especially pigment, such as carbon black, HOSTAPERM PINK™, or PV FAST BLUE™, in an aqueous surfactant solution containing a cationic surfactant, such as dialkylbenzene dialkylammonium chloride like SANIZOL B-50™ available from Kao or MIRAPOL™ available from Alkaril Chemicals by means of a high shearing device, such as a Brinkmann Polytron or IKA homogenizer; (ii) adding the aforementioned colorant, especially pigment, mixture to a mixture of water optional additives, and a latex miniemulsion of polymer particles of, for example, poly (styrene-butyl acrylate-acrylic acid), poly(styrene-butadiene-acrylic acid), and the like, an anionic surfactant, such as sodium dodecylsulfate, dodecylbenzene sulfonate or NEOGEN R™, a nonionic surfactant, such as polyethylene glycol or polyoxyethylene glycol nonyl phenyl ether or IGEPAL897™ obtained from GAF Chemical Company, and a cosurfactant, thereby causing a flocculation of pigment, polymer particles and optional additives; (iii) homogenizing the resulting flocculent mixture with a high shearing device, such as a Brinkmann Polytron or IKA homogenizer, and further stirring with a mechanical stirrer at a temperature of about 1° C. to about 25° C. below the Tg of the latex polymer to form toner sized aggregates of from about 2 microns to about 20 microns in volume average diameter; (iv) heating the mixture in the presence of additional anionic surfactant or nonionic surfactant at a temperature of 120° C. or below for a duration of, for example, from about 1 to about 5 hours to form 2 to about 12 micron toner, preferably with a particle size distribution of from about 1.15 to about 1.35 as measured by the Coulter Counter; and (v) isolating the toner particles by filtration, washing, and drying. Additives to improve flow characteristics and charge additives, if not initially present, to improve charging characteristics may then be added by blending with the formed toner, such additives, including AEROSILS® or silicas, metal oxides like tin, titanium and the like, metal salts of fatty acids like zinc stearate, and which additives are present in various effective amounts, such as from about 0.1 to about 10 percent by weight of the toner.

Illustrative examples of specific latex resin, polymer or polymers selected for the process of the present invention include known polymers, such as styrene acrylates, styrene butadienes, styrene methacrylates, and more specifically, poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(styrene-butyl acrylate-acrylonitrile -acrylic acid), poly(acrylonitrile-butyl acrylate-acrylic acid), and the like. The latex polymer is generally present in the toner compositions of the present invention in various effective amounts, such as from about 75 weight percent to about 98 weight percent, and preferably from about 85 weight percent to about 96 weight percent of the toner components, and the latex polymer size suitable for the processes of the present invention can be as indicated herein, and, for example, from about 0.05 micron to about 1 micron in volume average diameter as measured by the Brookhaven nanosize particle analyzer. Other sizes and effective amounts of latex polymer may be selected in embodiments.

The polymer selected for the process of the present invention is preferably prepared by emulsion polymerization methods, and the monomers utilized in such processes include styrene, acrylates, methacrylates, butadienes, isoprenes, acrylic acids, methacrylic acids, acrylonitriles, and the like. Known chain transfer agents, for example dodecanethiol, about 0.1 to about 10 percent, or carbon tetrabromide in effective amounts, such as from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654 the disclosure of which is totally incorporated herein by reference, mechanical grinding processes, or other known processes.

Various known colorants, such as pigments, present in the toner in an effective amount of, for example, from about 1 to about 15 percent by weight of toner, and preferably in an amount of from about 3 to about 10 percent by weight, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1 ™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, red, brown, orange, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be used include copper tetra(octadecyl sulfonamido) phthalocyanine, x-copper phthalocyanine pigment listed in the Color Index as CI 74160, Cl Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Colorants include pigment, dye, mixtures of pigment and dyes, mixtures of pigments, mixtures of dyes, and the like.

The toner may also include known charge additives in effective suitable amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in effective amounts of, for example, 0.01 to about 15 weight percent of the reaction mixture in embodiments include, for example, nonionic surfactants, such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL C-720™, IGEPAL CO-290™, IGEPAL CA-210™, ANTAROX 890™ and ANTAROX 897™ in effective amounts of, for example, from about 0.1 to about 10 percent by weight of the reaction mixture; anionic surfactants such as, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like, in effective amounts of, for example, from about 0.01 to about 10 percent by weight; cationic surfactants, such as, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to 4.

Examples of the surfactant, which are added to the aggregates before coalescence is initiated, can be anionic surfactants, such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant utilized in the coalescence to primarily stabilize the aggregate size against further growth with temperature is, for example, from about 0.01 to about 10 percent by weight, and preferably from about 0.5 to about 5 percent by weight of monomers used to prepare the copolymer resin.

Surface additives that can be added to the toner compositions after washing or drying include, for example, metal salts, metal salts of fatty acids, colloidal silicas, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. No. 4,937,166 and 4,935,326, the disclosures of which are totally incorporated herein by reference, for example from about 2 percent toner concentration to about 8 percent toner concentration. Also, there can be selected as carrier particles, or components a core with a coating thereover of polymethylmethacrylate with a conductive component dispersed therein, such as a conductive carbon black.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various pieces of the present invention. These Examples are intended to be illustrative only and are not intended to limit the scope of the present invention.

EXAMPLE I

A latex emulsion comprised of polymer particles derived from emulsion polymerization of styrene, butyl acrylate and acrylic acid was prepared as follows. 221.4 Grams of styrene, 48.6 grams of butyl acrylate, 5.4 grams of acrylic acid, 8.1 grams of 1-dodecanethiol, 2.7 grams of carbon tetrabromide, and 9.9 grams of hexadecane as the cosurfactant were mixed with 391 grams of deionized water in which 19.2 grams of sodium dodecyl benzene sulfonate anionic surfactant, NEOGEN R™ (20 percent active), 2.0 grams of polyoxyethylene nonyl phenyl ether—nonionic surfactant, ANTAROX CA 897™ (70 percent active), and 2.7 grams of ammonium persulfate initiator were dissolved. The resulting mixture was emulsified via VirTishear Cyclone Homogenizer at 10,000 rpm for 10 minutes. The resulting emulsion was then stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. A very mild exotherm of about 2° C. was observed during this emulsion polymerization. The resulting latex polymer after cooling throughout possessed an $M_w$ of 26,000, an $M_n$ of 7,200, as determined on a Waters GPC, and a mid-point Tg of 58.9° C., as measured on a Seiko DSC. The latex polymer, or latex resin possessed a volume average diameter for the polymer of 250 nanometers as measured by light scattering technique on a Coulter N4 Plus Particle Sizer.

No sediment was observed after the latex was allowed to stand for two full weeks, or 14 days. The amount of sediment determined via an IEC Centrifuge at 3,120 G-force for 50 seconds was less than 0.1 weight percent of the latex after two weeks.

260.0 Grams of the above prepared latex emulsion and 220.0 grams of an aqueous cyan pigment dispersion containing 7.6 grams of Cyan Pigment 15:3, and 2.3 grams of cationic surfactant, SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 53° C. for 2.5 hours before 40 milliliters of 20 percent aqueous NEOGEN R™ solution were added. Aggregates with a particle size (volume average diameter) of 6.2 microns with a GSD=1.20, as measured on the Coulter Counter, were obtained. Subsequently, the mixture was heated to 90° C. and held there for a period of 3 hours before cooling down to room temperature, about 25° C. throughout, filtered, washed with water, and dried in a freeze dryer. The final toner product evidenced a particle size of 6.4 microns in volume average diameter with a particle size distribution of 1.23 as measured on a Coulter Counter.

The resulting toner, that is the above final toner product was comprised of about 93 percent of polymer, poly (styrene-butyl acrylate-acrylic acid), and 15:3 cyan pigment, about 7 percent by weight of toner, with a volume average diameter of 6.4 microns and a GSD of 1.23, indicating that one can retain toner particle size and GSD achieved in the aggregation step during coalescence without the aggregates falling apart, or separating and without an excessive increase in particle size, when a sediment-free miniemulsion polymer was prepared by adding a cosurfactant of hexadecane to enhance the latex stability.

The major advantage of using the above miniemulsion latex is the absence, or substantial absence of sediments; reduced batch-to-batch variation, for example better reproducibility; reduced exotherm for the emulsion polymerization, and accelerated reaction rates.

EXAMPLE II

A latex emulsion comprised of polymer particles derived from emulsion polymerization of styrene, butyl acrylate and acrylic acid was prepared as follows. 221.4 Grams of styrene, 48.6 grams of butyl acrylate, 5.4 grams of acrylic acid, 8.1 grams of tertiary-dodecanethiol, 2.7 grams of carbon tetrabromide, and 7.6 grams of dodecane as the cosurfactant were mixed with 391 grams of deionized water in which 19.2 grams of sodium dodecyl benzene sulfonate anionic surfactant, NEOGEN R™ (20 percent active), 2.0 grams of polyoxyethylene nonyl phenyl ether—nonionic surfactant, ANTAROX CA 897™ (70 percent active), and 2.7 grams of ammonium persulfate initiator were dissolved. The resulting mixture was emulsified via VirTishear Cyclone Homogenizer at 10,000 rpm for 10 minutes. The resulting emulsion was then stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. A very mild exotherm of about 2° C. was observed during this emulsion polymerization. The resulting latex polymer possessed an $M_w$ of 27,000, an $M_n$ of 6,800, as determined on a Waters GPC, and a mid-point Tg of 58.0° C., as measured on a Seiko DSC. The latex showed a volume average diameter for the polymer of 232 nanometers as measured by the light scattering technique on a Coulter N4 Plus Particle Sizer.

No sediment was observed after the latex was allowed to stand for two weeks. The amount of sediment determined via an IEC Centrifuge at 3,120 G-force for 50 seconds was less than 0.1 weight percent of the latex.

260.0 Grams of the above prepared latex emulsion and 220.0 grams of an aqueous cyan pigment dispersion containing 7.6 grams of Cyan Pigment 15:3, and 2.3 grams of cationic surfactant, SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 53° C. for 2.5 hours before 40 milliliters of 20 percent aqueous NEOGEN R™ solution was added. Aggregates with a particle size (volume average diameter) of 6.1 microns with a GSD=1.20, as measured on the Coulter Counter, were obtained. Subsequently, the mixture was heated to 90° C. and held there for a period of 3 hours before cooling down to room temperature, about 25° C. throughout, filtered, washed with water, and dried in a freeze dryer. The final toner product evidenced a particle size of 6.5 microns in volume average diameter with a particle size distribution of 1.20 as measured on a Coulter Counter.

The resulting toner, that is the above final toner product, was comprised of about 93 percent of polymer, poly (styrene-butyl acrylate-acrylic acid), and 15:3 cyan pigment, about 7 percent by weight of toner, with a volume average diameter of 6.5 microns and a GSD of 1.20, indicating that one can retain toner particle size and GSD achieved in the aggregation step during coalescence without the aggregates falling apart and without an excessive increase in particle size, when a sediment-free miniemulsion polymer was selected with a cosurfactant dodecane to, for example, enhance the latex stability.

EXAMPLE III

A latex emulsion comprised of polymer particles derived from emulsion polymerization of styrene, butyl acrylate and acrylic acid was prepared as follows. 221.4 Grams of styrene, 48.6 grams of butyl acrylate, 5.4 grams of acrylic acid, 8.1 grams of tert-dodecanethiol, 2.7 grams of carbon tetrabromide, and 9.9 grams of hexadecane as the cosurfactant were mixed with 391 grams of deionized water in which 19.2 grams of sodium dodecyl benzene sulfonate anionic surfactant, NEOGEN R™ (20 percent active), 2.0 grams of polyoxyethylene nonyl phenyl ether—nonionic surfactant, ANTAROX CA 897™ (70 percent active), and 2.7 grams of ammonium persulfate initiator were dissolved. The resulting mixture was emulsified via VirTishear Cyclone Homogenizer at 10,000 rpm for 10 minutes. The resulting emulsion was then stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. A very mild exotherm of about 2° C. was observed during this emulsion polymerization. The resulting latex polymer possessed an $M_w$ of 28,000, an $M_n$ of 8,500, as determined on a Waters GPC, and a mid-point Tg of 57.5° C., as measured on a Seiko DSC. The latex polymer, or latex resin possessed a volume average diameter for the polymer of 282 nanometers as measured by light scattering technique on a Coulter N4 Plus Particle Sizer.

No sediment was observed after the latex was allowed to stand for two full weeks. The amount of sediment determined via an IEC Centrifuge at 3,120 G-force for 50 seconds was about 0.2 weight percent of the latex after two weeks.

260.0 Grams of the above prepared latex emulsion and 220.0 grams of an aqueous cyan pigment dispersion containing 7.6 grams of Cyan Pigment 15:3, and 2.3 grams of cationic surfactant, SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 53° C. for 2.5 hours before 40 milliliters of 20 percent aqueous NEOGEN R™ solution were added. Aggregates with a particle size (volume average diameter) of 5.6 microns with a GSD=1.20, as measured on the Coulter Counter, were obtained. Subsequently, the mixture was heated to 90° C. and held there for a period of 3 hours before cooling down to room temperature, about 25° C. throughout, filtered, washed with water, and dried in a freeze dryer. The final toner product evidenced a particle size of 5.7 microns in volume average diameter with a particle size distribution of 1.20 as measured on a Coulter Counter.

The resulting toner, that is the above final toner product, was comprised of about 93 percent of polymer, poly (styrene-butyl acrylate-acrylic acid), and 15:3 cyan pigment, about 7 percent by weight of toner, with a volume average diameter of 5.7 microns and a GSD of 1.20, indicating that one can retain toner particle size and GSD achieved in the aggregation step during coalescence without the aggregates falling apart, or separating and without an excessive increase in particle size, when a sediment-free miniemulsion polymer was prepared by adding a cosurfactant of hexadecane to enhance the latex stability.

EXAMPLE IV

A latex emulsion comprised of polymer particles derived from emulsion polymerization of styrene, butyl acrylate and acrylic acid was prepared as follows. 19.2 Grams of sodium dodecyl benzene sulfonate anionic surfactant, NEOGEN R™ (20 percent active), 2.0 grams of polyoxyethylene nonyl phenyl ether—nonionic surfactant, ANTAROX CA 897™ (70 percent active), 391 grams of deionized water, and 8.0 grams of cetyl alcohol as the cosurfactant were mixed at 65° C. for 2 hours, cooled to about 25° C. to form a gel phase, and sonified with a Bronwill Sonifier to break up the gel phase. The sonifier was operated at 50 percent duty cycle and power 7 for 60 seconds of sonification time. 221.4 Grams of styrene, 48.6 grams of butyl acrylate, 5.4 grams of acrylic acid, 8.1 grams of 1-dodecanethiol, 2.7 grams of carbon tetrabromide, and 2.7 grams of ammonium persulfate initiator were then mixed with above aqueous mixture by stirring at 250 rpm for 5 minutes. The resulting mixture was emulsified via VirTishear Cyclone Homogenizer at 10,000 rpm for 10 minutes. The resulting emulsion was then stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. A very mild exotherm of about 1.5° C. was observed during this emulsion polymerization. The resulting latex polymer possessed an $M_w$ of 23,500, an $M_n$ of 5,600, as determined on a Waters GPC, and a mid-point Tg of 56.1° C., as measured on a Seiko DSC. The latex showed a volume average diameter for the polymer of 185 nanometers as measured by light scattering technique on a Coulter N4 Plus Particle Sizer.

No sediment was observed after the latex was allowed to stand for two weeks. The amount of sediment determined via an IEC Centrifuge at 3,120 G-force for 50 seconds was about 0.2 weight percent of the latex.

260.0 Grams of the above prepared latex emulsion and 220.0 grams of an aqueous cyan pigment dispersion containing 7.6 grams of Cyan Pigment 15:3, and 2.3 grams of cationic surfactant, SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 50° C. for 2.5 hours before 40 milliliters of 20 percent aqueous NEOGEN R™ solution was added. Aggregates with a particle size (average volume diameter) of 5.7 microns with a GSD=1.21, as measured on the Coulter Counter, were obtained. Subsequently, the mixture was heated to 90° C. and held there for a period of 3 hours before cooling down to room temperature, about 25° C. throughout, filtered, washed with water, and dried in a freeze dryer. The final toner product evidenced a particle size of 5.9 microns in volume average diameter with a particle size distribution of 1.23 as measured on a Coulter Counter.

The resulting toner, that is the above final toner product, was comprised of about 93 percent of polymer, poly (styrene-butyl acrylate-acrylic acid), and 15:3 cyan pigment, about 7 percent by weight of toner, with a toner volume average diameter of 5.9 microns and a GSD of 1.23, indicating that one can retain toner particle size and GSD achieved in the aggregation step during coalescence, without the aggregates falling apart and without an excessive increase in particle size, when the above sediment-free miniemulsion polymer was prepared with a cosurfactant of cetyl alcohol to, for example, enhance the latex stability.

EXAMPLE V

A latex emulsion comprised of polymer particles derived from emulsion polymerization of styrene, butyl acrylate and acrylic acid was prepared as follows. 19.2 Grams of sodium dodecyl benzene sulfonate anionic surfactant, NEOGEN R™ (20 percent active), 2.0 grams of polyoxyethylene nonyl phenyl ether—nonionic surfactant, ANTAROX CA 897™ (70 percent active), 391 grams of deionized water, and 6.1 grams of lauryl alcohol as the cosurfactant were mixed at 65° C. for 2 hours, cooled to about 25° C. to form a gel phase, and sonified with a Bronwill Sonifier to break up the gel phase. The sonifier was operated at 50 percent duty cycle and power 7 for 60 seconds of sonification time. 221.4 Grams of styrene, 48.6 grams of butyl acrylate, 5.4 grams of acrylic acid, 8.1 grams of 1-dodecanethiol, 2.7 grams of carbon tetrabromide, and 2.7 grams of ammonium persulfate initiator were then mixed with above aqueous mixture by stirring at 250 rpm for 5 minutes. The resulting mixture was emulsified via VirTishear Cyclone Homogenizer at 10,000 rpm for 10 minutes. The resulting emulsion was then stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. A very mild exotherm of about 2° C. was observed during this emulsion polymerization. The resulting latex polymer possessed an $M_w$ of 22,400, an $M_n$ of 5,200, as determined on a Waters GPC, and a mid-point Tg of 56.0° C., as measured on a Seiko DSC. The latex showed a volume average diameter for the polymer of 173 nanometers as measured by light scattering technique on a Coulter N4 Plus Particle Sizer.

No sediment was observed after the latex was allowed to stand for two weeks. The amount of sediment determined via an IEC Centrifuge at 3,120 G-force for 50 seconds was less than 0.1 weight percent of the latex.

260.0 Grams of the above prepared latex emulsion and 220.0 grams of an aqueous cyan pigment dispersion containing 7.6 grams of Cyan Pigment 15:3, and 2.3 grams of cationic surfactant, SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 50° C. for 2.5 hours before 40 milliliters of 20 percent aqueous NEOGEN R™ solution were added. Aggregates with a particle size (volume average diameter) of 6.0 microns with a GSD=1.18, as measured on the Coulter Counter, were obtained. Subsequently, the mixture was heated to 90° C. and held there for a period of 3 hours before cooling down to room temperature, about 25° C. throughout, filtered, washed with water, and dried in a freeze dryer. The final toner product evidenced a particle size of 6.1 microns in volume average diameter with a particle size distribution of 1.17 as measured on a Coulter Counter.

The resulting toner, that is the above final toner product, was comprised of about 93 percent of polymer, poly (styrene-butyl acrylate-acrylic acid), and 15:3 cyan pigment, about 7 percent by weight of toner, with a volume average diameter of 6.1 microns and a GSD of 1.17, indicating that one can retain toner particle size and GSD achieved in the aggregation step during coalescence without the aggregates falling apart and without an excessive increase in particle size, when the above sediment-free miniemulsion polymer was prepared with a cosurfactant of lauryl alcohol to, for example, enhance the latex stability.

EXAMPLE VI

Process Reproducibility

Four batches of latex emulsion comprised of polymer particles derived from emulsion polymerization of styrene, butyl acrylate and acrylic acid were prepared as follows. 221.4 Grams of styrene, 48.6 grams of butyl acrylate, 5.4 grams of acrylic acid, 8.1 grams of 1-dodecanethiol, 2.7 grams of carbon tetrabromide, and 9.9 grams of hexadecane as the cosurfactant were mixed with 391 grams of deionized water in which 19.2 grams of sodium dodecyl benzene sulfonate anionic surfactant, NEOGEN R™ (20 percent active), 2.0 grams of polyoxyethylene nonyl phenyl ether—nonionic surfactant, ANTAROX CA 897™ (70 percent active), and 2.7 grams of ammonium persulfate initiator were dissolved. The resulting mixture was emulsified via VirTishear Cyclone Homogenizer at 10,000 rpm for 10 minutes. The resulting emulsion was then stirred at room temperature of about 25° C. under a nitrogen atmosphere for 30 minutes. Subsequently, the mixture was stirred and heated to 70° C. at a rate of 1° C. per minute, and retained at this temperature for 6 hours. A very mild exotherm of about 2° C. was observed during this emulsion polymerization. Characterization of the resulting four batches of latex are shown in the following Table 1.

TABLE 1

Properties of Latex Prepared Using the Miniemulsion Process

| Batch No. | Latex Diameter (nm) | Tg °C. | $M_w$ | $M_n$ |
|---|---|---|---|---|
| 1 | 250 | 58.9 | 26,000 | 7,200 |
| 2 | 243 | 57.7 | 25,000 | 6,800 |
| 3 | 259 | 58.5 | 26,000 | 7,000 |
| 4 | 247 | 58.2 | 25,000 | 6,700 |

Table 1 illustrates a polymer latex volume average diameter of 250 manometers as measured by light scattering technique on a Coulter N4 Plus Particle Sizer, molecular weights of $M_w$=25,500 and $M_n$=6,900 as determined on a Waters GPC, and a mid-point Tg of 58.3° C., as measured on a Seiko DSC.

No sediment was observed after the aforementioned four batches of latex were allowed to stand for two weeks. The amount of sediment of each batch of latex, as determined via an IEC Centrifuge at 3,120 G-force for 50 seconds, was less than 0.1 weight percent of the latex.

Four batches of toners were prepared using the above prepared four batches as follows. 260.0 Grams of the latex emulsion and 220.0 grams of an aqueous cyan pigment dispersion containing 7.6 grams of Cyan Pigment 15:3, and 2.3 grams of cationic surfactant, SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 53° C. for 2.5 hours before 40 milliliters of 20 percent aqueous NEOGEN R™ solution were added. Subsequently, the mixture was heated to 90° C. and held there for a period of 3 hours before cooling down to room temperature, about 25° C. throughout, filtered, washed with water, and dried in a freeze dryer. The above aggregation and coalescence were used for each batch of latex to prepare four batches of toner. The particle size of each batch of the final toner product was measured on a Coulter Counter. Results are shown in Table 2.

TABLE 2

Properties of Toners Prepared Using the Miniemulsion Latexes

| Batch No. | $d_{50}$ (micron) | GSD |
|---|---|---|
| 1 | 6.4 | 1.23 |
| 2 | 6.0 | 1.21 |
| 3 | 6.5 | 1.24 |
| 4 | 6.2 | 1.20 |

The resulting four batches of toner products were comprised of about 93 percent of polymer, poly(styrene-butyl acrylate-acrylic acid), and 15:3 cyan pigment, about 7 percent by weight of toner, with a volume average of 6.3 microns and an average GSD of 1.22, indicating, for example, the reproducibility of processes of the present invention.

EXAMPLE VII

A latex emulsion comprised of polymer particles derived from emulsion polymerization of styrene, butyl acrylate and acrylic acid was prepared as follows. 1-Dodecanthiol, having a solubility in water of $3.0\times10^{-5}$ grams per liter of water at 25° C., was used as a cosurfactant and as a primary chain transfer agent. 442.8 Grams of styrene, 96.6 grams of butyl acrylate, 10.8 grams of acrylic acid, and 14.6 grams of 1-dodecanethiol were mixed with 782 grams of deionized water in which 38.3 grams of sodium dodecyl benzene sulfonate anionic surfactant, NEOGEN R™ (20 percent active), 11.6 grams of polyoxyethylene nonyl phenyl ether—nonionic surfactant, ANTAROX CA 897™ (70 percent active), and 5.4 grams of ammonium persulfate initiator were dissolved. The resulting mixture was emulsified via VirTishear Cyclone Homogenizer at 10,000 rpm for 25 minutes. The resulting emulsion was then stirred at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. A very mild exotherm of about 2° C. was observed during this emulsion polymerization. The resulting latex polymer possessed an $M_w$ of 26,600, an $M_n$ of 7,000, as determined on a Waters GPC, and a mid-point Tg of 57.8° C., as measured on a Seiko DSC. The latex polymer, or latex resin possessed a volume average diameter for the polymer of 129 nanometers as measured by light scattering technique on a Coulter N4 Plus Particle Sizer.

No sediment was observed after the latex was allowed to stand for two full weeks. The amount of sediment determined via an IEC Centrifuge at 3,120 G-force for 50 seconds was about 0.3 weight percent of the latex after two weeks.

260.0 Grams of the above prepared latex emulsion and 220.0 grams of an aqueous cyan pigment dispersion containing 7.6 grams of Cyan Pigment 15:3, and 2.8 grams of cationic surfactant, SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 50° C. for 2 hours before 20 milliliters of 20 percent aqueous NEOGEN R™ solution were added. Aggregates with a particle size (volume average diameter) of 6.1 microns with a GSD=1.20, as measured on the Coulter Counter, were obtained. Subsequently, the mixture was heated to 94° C. and held there for a period of 2 hours before cooling down to room temperature, about 25° C. throughout, filtered, washed with water, and dried in a freeze dryer. The final toner product evidenced a particle size of 6.4 microns in volume average diameter with a particle size distribution of 1.23 as measured on a Coulter Counter.

The resulting toner, that is the above final toner product, was comprised of about 93 percent of polymer, poly (styrene-butyl acrylate-acrylic acid), and 15:3 cyan pigment, about 7 percent by weight of toner, with a volume average diameter of 6.4 microns and a GSD of 1.23, indicating that one can retain toner particle size and GSD achieved in the aggregation step during coalescence without the aggregates falling apart, or separating and without an excessive increase in particle size, when a sediment-free miniemulsion polymer was prepared by using a cosurfactant and a chain transfer agent of long chain alkyl mercaptan, for example 1-dodecanethiol, to enhance the latex stability.

COMPARATIVE EXAMPLE IA

A latex emulsion comprised of polymer particles derived from emulsion polymerization of styrene, butyl acrylate and acrylic acid was prepared as follows. 221.4 Grams of styrene, 48.6 grams of butyl acrylate, 5.4 grams of acrylic acid, 8.1 grams of 1-dodecanethiol, and 2.7 grams of carbon tetrabromide were mixed with 391 grams of deionized water in which 19.2 grams of sodium dodecyl benzene sulfonate anionic surfactant, NEOGEN R™ (20 percent active), 2.0 grams of polyoxyethylene nonyl phenyl ether—nonionic surfactant, ANTAROX CA 897™ (70 percent active), and 2.7 grams of ammonium persulfate initiator were dissolved. The resulting mixture was emulsified via VirTishear Cyclone Homogenizer at 10,000 rpm for 10 minutes. The resulting emulsion was then stirred at room temperature of about 25° C. under a nitrogen atmosphere for 30 minutes. Subsequently, the mixture was stirred and heated to 70° C. at a rate of 1° C. per minute, and retained at this temperature for 6 hours. A high exotherm of about 6° C. was observed during this emulsion polymerization. The resulting latex polymer possessed an $M_w$ of 27,000, an $M_n$ of 6,000, as determined on a Waters GPC, and a mid-point Tg of 57.0° C., as measured on a Seiko DSC. The latex showed a volume average diameter for the polymer of 256 nanometers as measured by light scattering technique on a Coulter N4 Plus Particle Sizer.

Sediment containing low $M_w$ and low Tg polymer particles was observed after the latex was allowed to stand for two days. The amount of sediment determined via an IEC Centrifuge at 3,120 G-force for 50 seconds was less about 5.8 weight percent of the prepared latex, which contained undesirable polymer particles with low $M_w$=16,600 and a low glass transition temperature of 28° C. This undesirable portion of the latex can be removed from the remainder of the latex by a known sedimentation technique. The amount of this undesirable latex sediment was significantly reduced by the invention miniemulsion polymerization processes utilizing a cosurfactant. A sediment is a latex containing undesirable polymer particles with a large particle size, low molecular weight and low Tg. An emulsion product containing some sediment is not as suitable both for the aggregation/coalescence processes and for generating toner compositions. A sediment can cause the aggregates to have a greater propensity to fall apart or an excessive increase in particle size, as evidenced by the final toner particle size and GSD. Therefore, the sediment is usually removed prior to the aggregation/coalescence to retain toner particle size with a narrow GSD. Sediment generated during the emulsion polymerization will result in loss of material, lower production yield, waste disposal, and a need for additional capital investment for sediment removal equipment such as a centrifuge.

In this Comparative Example, the undesirable polymer particles were not removed in order to be able to compare the results of this Comparative Example with Examples I to V. 260.0 Grams of the above prepared latex emulsion and 220.0 grams of an aqueous cyan pigment dispersion containing 7.6 grams of Cyan Pigment 15:3, and 2.3 grams of cationic surfactant, SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 53° C. for 2.5 hours before 40 milliliters of 20 percent aqueous NEOGEN R™ solution was added. Aggregates with a particle size (volume average diameter) of 5.5 microns with a GSD=1.24, as measured on the Coulter Counter, were obtained. Subsequently, the mixture was heated to 90° C. and held there for a period of 3 hours before cooling down to room temperature, about 25° C. throughout, filtered, washed with water, and dried in a freeze dryer. The final toner product evidenced a particle size of 6.4 microns in volume average diameter with a particle size distribution of 1.33 as measured on a Coulter Counter.

The results in Examples I to V indicate that the miniemulsion enhanced the latex stability observed during emulsion polymerization and minimizes/eliminates the amount of sediment, the undesirable polymer particles, prepared during emulsion polymerization. An emulsion product containing sediment having undesirable properties is not as suitable both for aggregation/coalescence processes and for generating a toner composition. Sediment in an emulsion causes the aggregates to fall apart or grow substantially, as demonstrated by this Comparative Example. As demonstrated by the above Examples I to V, the use of the miniemulsion polymerization with a cosurfactant can increase the latex stability and can yield latexes with desirable characteristics with respect to their use in aggregation processes.

Other modifications of the present invention will occur to those of ordinary skill in the art subsequent to a review of the present application. These modifications and equivalents thereof are intended to be included within the scope of the present invention.

What is claimed is:

1. A process for the preparation of toner comprising (i) aggregating a colorant dispersion with a latex miniemulsion containing polymer, an ionic surfactant, a cosurfactant to increase said latex miniemulsion stability and reduce sediment, and a nonionic surfactant;

(ii) coalescing or fusing the aggregates generated; and optionally (iii) cooling, isolating, washing, and drying the toner, and wherein the polymer in said miniemulsion is of a diameter of from about 50 to about 500 nanometers.

2. A process in accordance with claim 1 wherein said aggregating is below about the polymer glass transition temperature present in the latex emulsion, the coalescing or fusing of said aggregates is above about the polymer glass transition temperature, and wherein said polymer diameter is from about 100 to about 250 nanometers, and there results toner with a size of from about 2 to about 20 microns in volume average diameter; and wherein (iii) is accomplished.

3. A process in accordance with claim 2 wherein said temperature below the glass transition temperature is from about 25° C. to about 60° C., and the heating above the glass transition temperature is from about 60° C. to about 100° C.; and wherein (iii) is accomplished.

4. A process in accordance with claim 2 wherein said temperature below the glass transition temperature is from about 35° C. to about 55° C., and the heating above the glass transition temperature is from about 70° C. to about 95° C.; and wherein (iii) is accomplished.

5. A process in accordance with claim 2 wherein the temperature at which said aggregation is accomplished controls the size of the aggregates, and wherein the final toner size is from about 2 to about 10 microns in volume average diameter, and wherein the temperature and time of said coalescence or fusion of the components of aggregates control the shape of the resultant toner.

6. A process in accordance with claim 2 wherein the aggregation temperature is from about 45° C. to about 55° C., and wherein the coalescence or fusion temperature is from about 80° C. to about 95° C.

7. A process in accordance with claim 1 wherein the cosurfactant is selected from the group consisting of components of alkanes, hydrocarbyl alcohols, ethers, alkyl thiols, amines, halides, and esters.

8. A process in accordance with claim 1 wherein the cosurfactant is an alkane with from about 10 to about 24 carbon atoms, and wherein said alkane is present in an amount of from about 0.05 to about 5 parts.

9. A process in accordance with claim 1 wherein the cosurfactant is an alcohol, or an alkyl thiol.

10. A process in accordance with claim 9 wherein the alcohol contains from about 10 to about 20 carbon atoms.

11. A process in accordance with claim 9 wherein the alcohol is decanol, lauryl alcohol, tetradecanol, cetyl alcohol, or octadecanol.

12. A process in accordance with claim 9 herein the alcohol is present in an amount of from about 0.1 to about 5 parts.

13. A process in accordance with claim 8 wherein the alkane is n-decane, dodecane, tetradecane, hexadecane, or octadecane.

14. A process in accordance with claim 1 wherein the colorant is a pigment, and wherein said pigment dispersion contains an ionic surfactant, and the minilatex emulsion contains a nonionic surfactant and an ionic surfactant of opposite charge polarity to that of ionic surfactant present in said pigment dispersion.

15. A process in accordance with claim 1 wherein the surfactant utilized in said colorant dispersion is a cationic surfactant, and the ionic surfactant present in the latex mixture is an anionic surfactant.

16. A process in accordance with claim 2 wherein the aggregation is accomplished at a temperature of from about 15° C. to about 1° C. below the Tg of the latex polymer, or latex resin for a duration of from about 0.5 hour to about 3 hours.

17. A process in accordance with claim 1 wherein the coalescence or fusion of the components of aggregates for the formation of integral toner particles comprised of colorant, resin and additives is accomplished at a temperature of about 85° C. to about 105° C. for a duration of from about 1 hour to about 5 hours; and (iii) is accomplished.

18. A process in accordance with claim 1 wherein the latex polymer is selected from the group consisting of poly(styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), wherein said polymer is present in an amount of from about 80 percent by weight to about 98 percent by weight of toner, and wherein said colorant is a pigment; and (iii) is accomplished.

19. A process in accordance with claim 1 wherein the latex polymer is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile -acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), wherein said polymer is optionally present in an amount of from 80 percent by weight to about 98 percent by weight of toner, and wherein said colorant is a pigment.

20. A process in accordance with claim 1 wherein the ionic surfactant is selected from the group consisting of sodium dodecyl sulfate, sodium dodecylbenzene sulfate and sodium dodecylnaphthalene sulfate, and wherein colorant dispersion contains a cationic surfactant of a quaternary ammonium salt.

21. A process in accordance with claim 1 wherein the colorant is carbon black, magnetite, cyan, yellow, magenta, and mixtures thereof.

22. A process in accordance with claim 1 wherein (iii) is accomplished and the toner particles isolated are from about 2 to about 10 microns in volume average diameter, and the particle size distribution thereof is from about 1.15 to about 1.30, wherein each of the surfactants utilized represents from about 0.01 to about 5 weight percent of the total reaction mixture, and wherein there is added to the surface of the formed toner metal salts, metal salts of fatty acids, silicas, metal oxides, or mixtures thereof, each in an amount of from about 0.1 to about 10 weight percent of the obtained toner particles.

23. A process in accordance with claim 1 wherein the polymer in said miniemulsion is of a diameter of from about 100 to about 400 nanometers, or wherein the polymer in said miniemulsion is of a diameter of from about 100 to about 300 nanometers.

24. A process for the preparation of toner which comprises aggregating a colorant dispersion and a latex miniemulsion containing polymer of a diameter of from about 50 to about 500 nanometers, an ionic surfactant, a cosurfactant to increase said latex miniemulsion stability and reduce sediment, and a nonionic surfactant;

coalescing the aggregates generated; and isolating, washing, and drying the toner; and wherein said aggregating is accomplished by heating about below or about equal to the glass transition temperature of said polymer, and said coalescing is accomplished by heating about above or about equal to the glass transition temperature of said polymer.

* * * * *